US010160591B1

(12) United States Patent
Kawalchuk, Jr.

(10) Patent No.: US 10,160,591 B1
(45) Date of Patent: Dec. 25, 2018

(54) AEROSOL VALVES FOR SOLUBLE COMPRESSED GAS PROPELLANTS

(75) Inventor: John T. Kawalchuk, Jr., Carmel, NY (US)

(73) Assignee: PRECISION VALVE CORPORATION, Greenville, SC (US)

( * ) Notice: Subject to any disclaimer, the term of this patent is extended or adjusted under 35 U.S.C. 154(b) by 204 days.

(21) Appl. No.: 13/534,886

(22) Filed: Jun. 27, 2012

(51) Int. Cl.
*B65D 83/48* (2006.01)

(52) U.S. Cl.
CPC ..... *B65D 83/48* (2013.01)

(58) Field of Classification Search
CPC ..... B65D 83/00; B65D 83/14; B65D 83/42; B65D 83/425
USPC ..... 222/402.1, 402.16, 402.18; 141/20, 3
See application file for complete search history.

(56) References Cited

U.S. PATENT DOCUMENTS

| | | | | |
|---|---|---|---|---|
| 2,890,817 | A * | 6/1959 | Rheinstrom | 222/402.16 |
| 3,158,298 | A * | 11/1964 | Briechle | 222/402.16 |
| 3,257,035 | A * | 6/1966 | Jones | 222/82 |
| 3,375,957 | A | 4/1968 | Kuffer | |
| 3,651,997 | A * | 3/1972 | Venus, Jr. | 222/402.16 |
| 3,838,799 | A * | 10/1974 | Meuresch et al. | 222/402.16 |
| 3,845,887 | A * | 11/1974 | Meuresch et al. | 222/402.16 |
| 4,015,757 | A | 4/1977 | Meuresch et al. | |
| 4,271,875 | A * | 6/1981 | Meshberg | 141/3 |
| 4,441,634 | A * | 4/1984 | Meshberg | 222/402.16 |
| 4,615,470 | A | 10/1986 | Hyland et al. | |
| 6,279,623 | B1 * | 8/2001 | Smith | 141/20 |
| 7,959,041 | B2 * | 6/2011 | Miller et al. | 222/402.16 |
| 8,317,062 | B2 * | 11/2012 | Bodet et al. | 222/95 |

FOREIGN PATENT DOCUMENTS

| | | |
|---|---|---|
| GB | 2014248 A | 8/1979 |
| GB | 2143590 A | 2/1985 |
| JP | 48-92915 | 12/1973 |
| JP | 51-126509 | 11/1976 |
| JP | 2005-271921 A | 10/2001 |
| JP | 2004-515334 | 5/2004 |
| WO | 02/06134 | 1/2002 |

OTHER PUBLICATIONS

Chinese Office Action dated Nov. 11, 2013 corresponding to Chinese Application No. 201320382411.2; 1 page.
Japanese Office Action dated Mar. 7, 2017 from corresponding Japanese Patent Application No. 2015-520500, 11 pages.
International Search Report dated Aug. 22, 2013 corresponding to patent application No. PCT/US13/48171; 3 pages.
Written Opinion of the International Searching Authority dated Aug. 22, 2013 corresponding to patent application No. PCT/US13/48171; 6 pages.
Supplementary European Search Report dated Mar. 15, 2016 from corresponding European Patent Application No. 13808661.6, 10 pages.

* cited by examiner

*Primary Examiner* — Benjamin R Shaw
(74) *Attorney, Agent, or Firm* — Ohlandt, Greeley, Ruggiero & Perle, L.L.P.

(57) ABSTRACT

A valve housing for use in an aerosol valve is provided. The valve housing includes a tail piece and an upper edge or crown having at least one filling slot defined therein. The tail piece defines a first minimum filling area therethrough, while the at least one filling slot defines a second minimum filling area. The housing has a ratio of the first minimum filling area to the second minimum filling area being between 1 to 0.5 and 1 to 4.

21 Claims, 13 Drawing Sheets

AEROSOL VALVES FOR SOLUBLE COMPRESSED GAS PROPELLANTS

BACKGROUND OF THE INVENTION

1. Field of the Invention

The present disclosure is related to aerosol valves. More particularly, the present disclosure is related to aerosol valves and valve housings for use with pressure filled soluble compressed gas propellants.

2. Description of Related Art

Aerosol valves are sometimes used in combination with liquefied propellants, which are gases that exist as liquids under pressure. The product is expelled from the container as a result the liquid propellant turning into gas when the aerosol valve is opened such that the gas forces the product from the container through the open valve.

The use of liquefied propellants has several draw backs, including the propellant becoming an essential element in the product formulation and the liquid propellant having adverse environmental affects once expelled.

More recently, compressed gas propellants have been used in place of liquefied propellants. In use, when the aerosol valve is opened, the compressed gas pushes the product out of the container. In some instances, the compressed gas is a non-soluble compressed gas such as, but not limited to, compressed air and nitrogen. In other instances, the compressed gas is a soluble compressed gas such as, but not limited to carbon dioxide.

When filling containers with liquefied and compressed gas propellants, it is commonplace to fill the container through the aerosol valve, often referred to pressure filling. Here, the speed with which a processing line can fill containers is directly related to the chosen filling pressure.

During some pressure filling operations, the propellant is passed into the container through the valve housing, past the valve stem, and through the dip tube. Unfortunately, it has been determined by the present disclosure that when the filling pressure is too high, the flow of gas through the dip tube can be sufficient to dislodge the dip tube from the valve housing, rending the device inoperable.

In other pressure filling operations, the propellant is passed into the container over the valve housing through castellated slots in the crown on the housing as disclosed in U.S. Pat. No. 3,158,298 to Briechle. By providing a filling path over the valve housing, the line speed of the filling operation can be increased without dislodging the dip tube from the valve housing.

Unfortunately, it has been determined by the present disclosure that pressure filling of soluble compressed gas over the valve housing can result in an insufficient amount of the propellant becoming solubilized in the product, which can prevent the user from expelling product from the container, rending the device inoperable.

Thus, it has been determined by the present disclosure that there is a need for aerosol valves and valve housings for use with soluble compressed gas propellants that overcome, alleviate, and/or mitigate one or more of the aforementioned and other deleterious effects of prior art aerosol valves and housings.

BRIEF SUMMARY OF THE INVENTION

A valve housing for use in an aerosol valve is provided. The valve housing includes a tail piece and an upper edge or crown having at least one filling slot defined therein. The tail piece defines a first minimum filling area therethrough, while the at least one filling slot defines a second minimum filling area. The housing has a ratio of the first minimum filling area to the second minimum filling area being between 1 to 0.5 and 1 to 4.

An aerosol valve is also provided. The aerosol valve includes a valve housing comprising a tail piece and an upper edge or crown, a valve stem in the valve housing, and a dip tube disposed on the tail piece. A first minimum filling area is defined through the valve stem, the tail piece, and the dip tube, while a second minimum filling area is defined over the valve housing. A ratio of the first minimum filling area to the second minimum filling area is between 1 to 0.5 and 1 to 4.

The above-described and other features and advantages of the present disclosure will be appreciated and understood by those skilled in the art from the following detailed description, drawings, and appended claims.

DETAILED DESCRIPTION OF THE INVENTION

Figure 1:
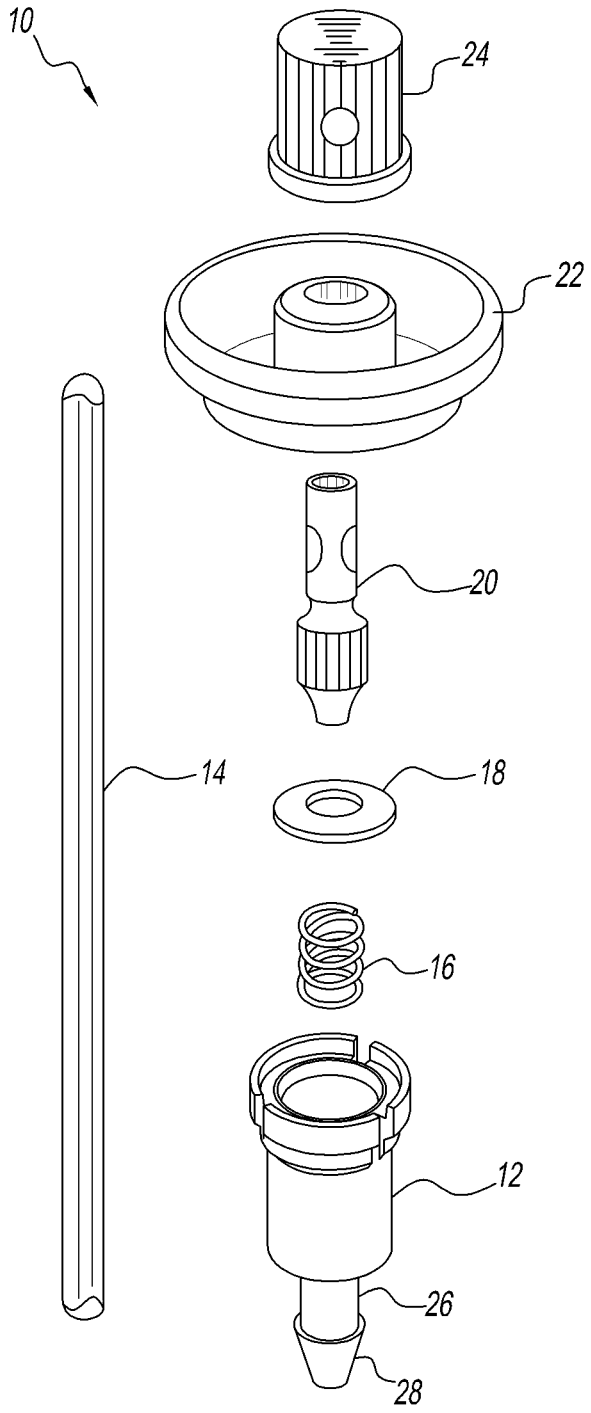
FIG. 1 is an exploded perspective view of an aerosol valve according to the present disclosure
Figure 2:
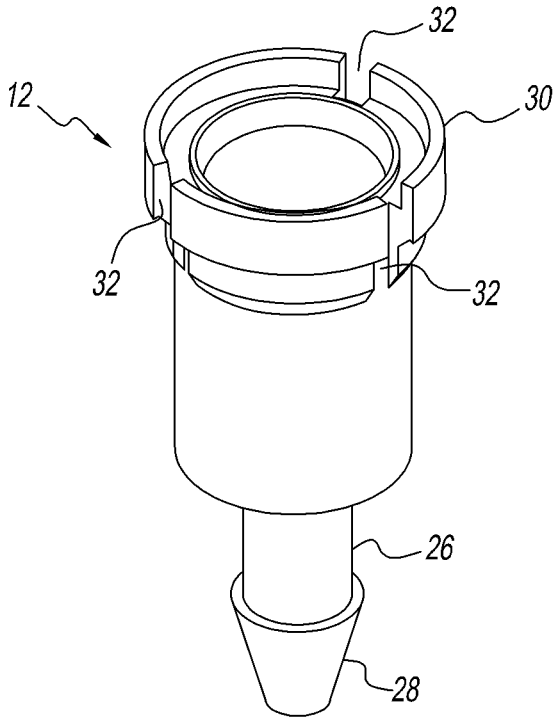
FIG. 2 is a perspective view of an exemplary embodiment of a valve housing according to the present disclosure.
Figure 3:
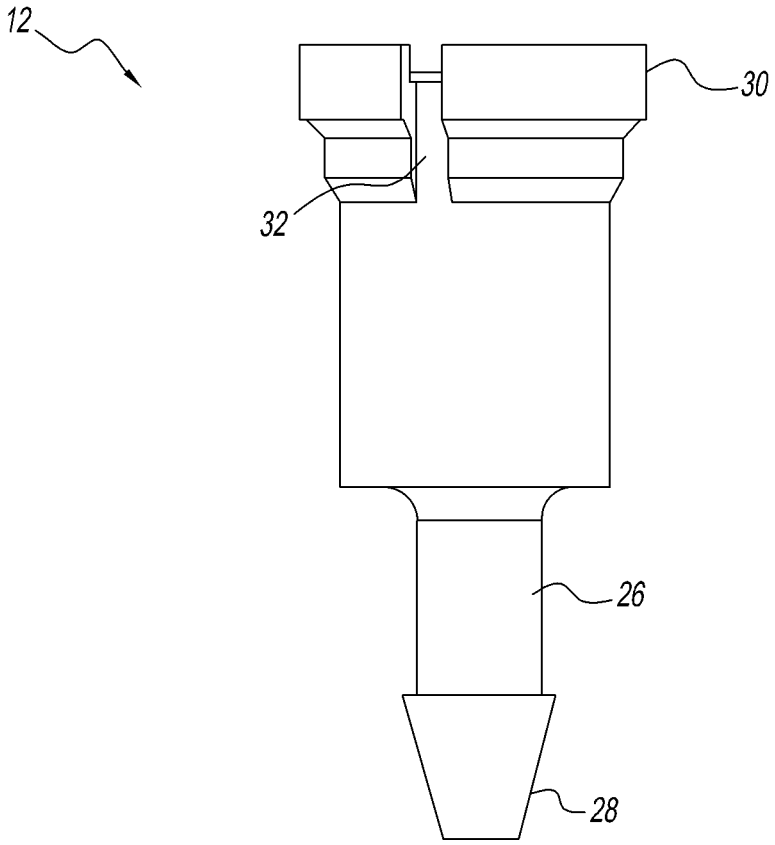
FIG. 3 is a side view of the valve housing of FIG. 2.
Figure 4:
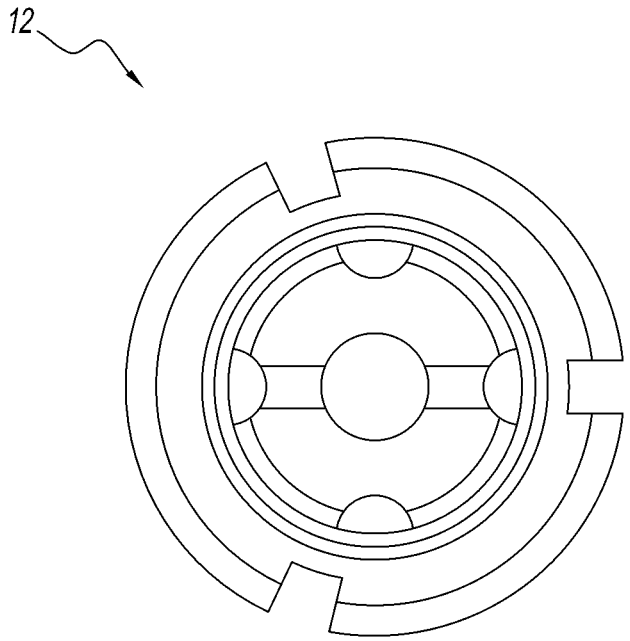
FIG. 4 is top view of the valve housing of FIG. 2 having various dimensions provided.

Referring to the drawings and in particular to FIG. 1, an exemplary embodiment of an aerosol valve according to the present disclosure is shown and is generally referred to by reference numeral 10. Advantageously, aerosol valve 10 is configured to maximize the filling rate when pressure filled with soluble compressed gas propellants.

Aerosol valve 10 includes a valve housing 12, a dip tube 14, a return spring 16, a valve gasket 18, a valve stem 20, a mounting cup 22, and a dispensing button 24 assembled in a known manner. Aerosol valve 10 is used in combination with a container (not shown) by securing mounting cup 22 onto the container in a known manner.

Valve housing 12 includes a tail piece 26 having a barb 28 disposed thereon. Dip tube 14 is secured to valve housing 12 by frictionally fitting an internal diameter of the dip tube over tail piece 26 and barb 28.

Valve housing 12 is described in further detail with simultaneous reference to FIGS. 2 through 6.

Valve housing 12 includes an upper edge or crown 30 having at least one filling slot 32 defined therein. Advantageously, filling slots 32 are configured to provide, during pressure filling operations with soluble compressed gas, a balance of flow through dip tube 14 and over valve housing 12, while ensuring saturation or solubility of the compressed gas into the product.

In this manner, aerosol valve 10, which includes valve housing 12, can be pressure filled with soluble compressed gases at higher pressures than previously possible, which allows the line speed of the filling line to be increased above that previously possible.

Particularly, valve housing 12 is configured, via filling slots 32, to achieve optimum saturation or solubility of the compressed gases into the product in the fastest time, without causing a potentially catastrophically high head space pressure which would cause the container (not shown) to fail for example bottom dome inversion, or rupture. Stated another way, valve housing 12 is configured, via filling slots 32, to balance the proportion of compressed gas being injected into the liquid formulation through dip tube 14 with the proportion of compressed gas being injected into the head space of container through the filling slots 32.

Without wishing to be bound by any particular theory, it is believed that valve housing 12 has a balance of the relative gas flow paths between a primary flow path 36 through the valve housing and dip tube 14 and a secondary flow path 38 over the valve housing at crown 30 through filling slots 32. The balance between the primary and secondary flow paths 36, 38 is influenced by a number of different variables including, but not limited to, the size of each fluid path, the drag through each path, the fluid viscosity, and the filling pressure.

It is also believed that the solubility of the gas in the product depends on, among other factors, the surface area of the gas that is exposed to the product. When filling over the valve housing (i.e., second minimum filling area 38), the interface between the gas and product is limited to the surface area of the product in the container. In contrast, when filling through the dip tube (i.e. first minimum filling area 36), the gas exiting the dip tube 14 forms bubbles in the product, providing a larger surface interface and, thus, a greater solubility of the gas in the product.

It has surprisingly been found that the complex set of fluid dynamic and solubility variables necessary to balance the primary and secondary flows can be simplified by comparing the minimum areas through each flow path.

Figure 5:
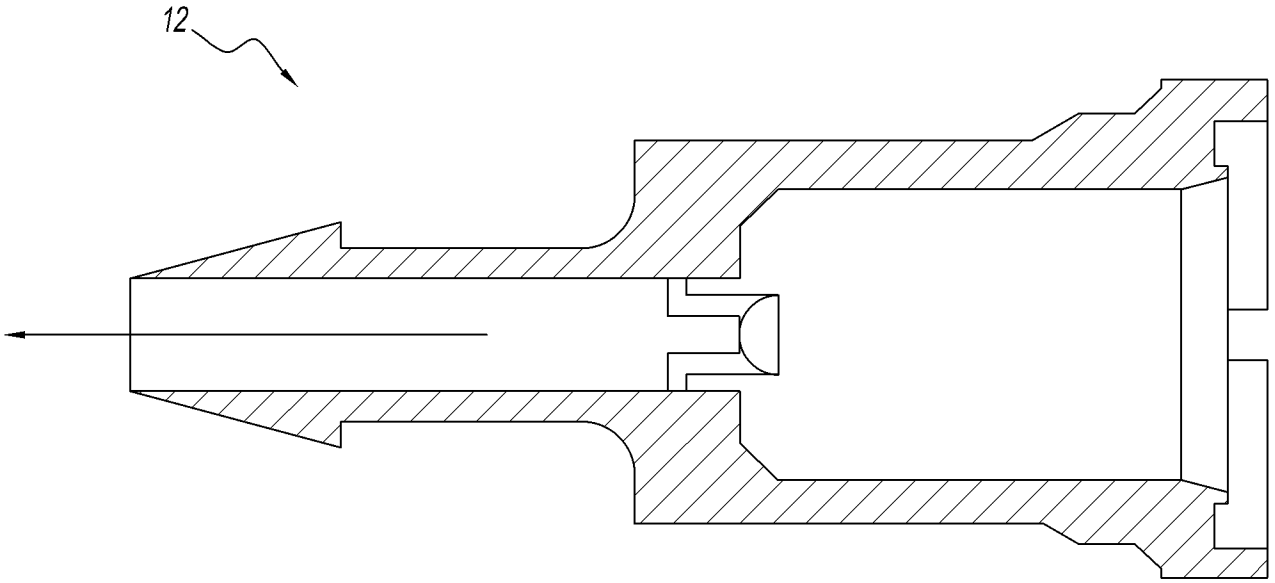
FIG. 5 is sectional view of the valve housing of FIG. 2 taken along lines 4-4 in FIG. 4 having various dimensions provided.

Referring to FIG. 5, the minimum area of the first flow path 36 is defined by the minimum dimension through valve stem 20, dip tube 14, tail piece 26, and barb 28. Conversely, and referring to FIG. 6, the minimum area of the second flow path 38 is defined by adding up the individual areas through each of the filling slots 32.

Figure 8:
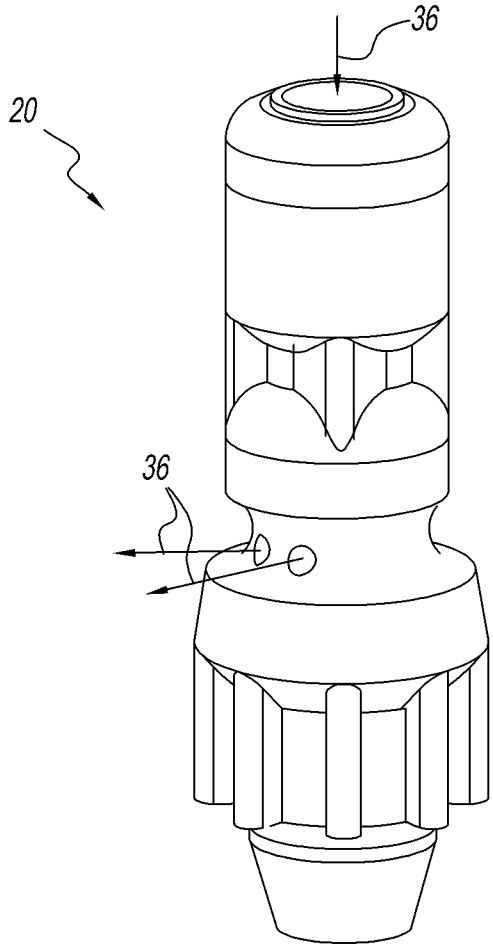
FIG. 8 is a perspective view of an exemplary embodiment of a valve housing for use with the aerosol valve of FIG. 1.
Figure 9:
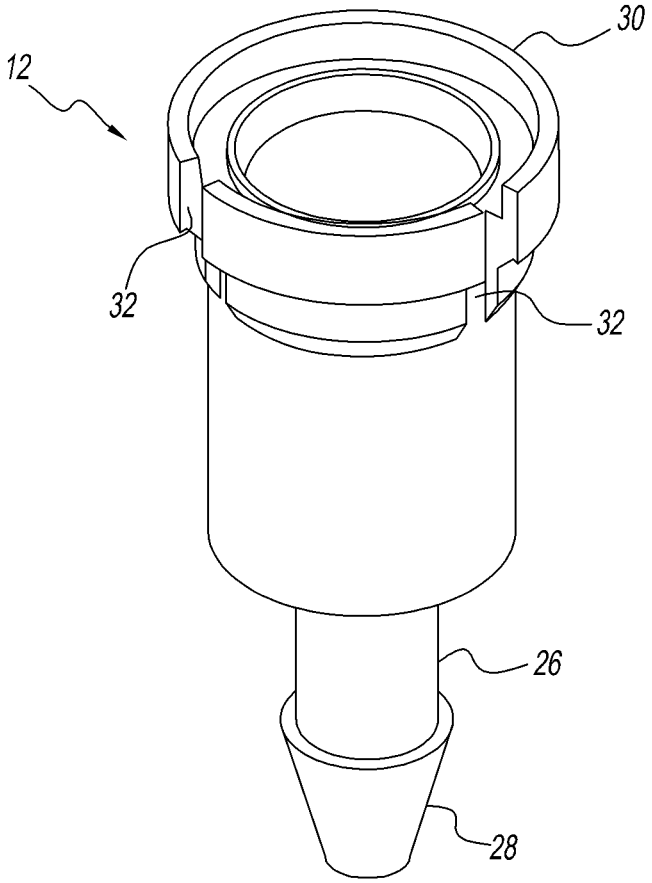
FIG. 9 is a perspective view of an alternate exemplary embodiment of a valve housing according to the present disclosure.
Figure 10:
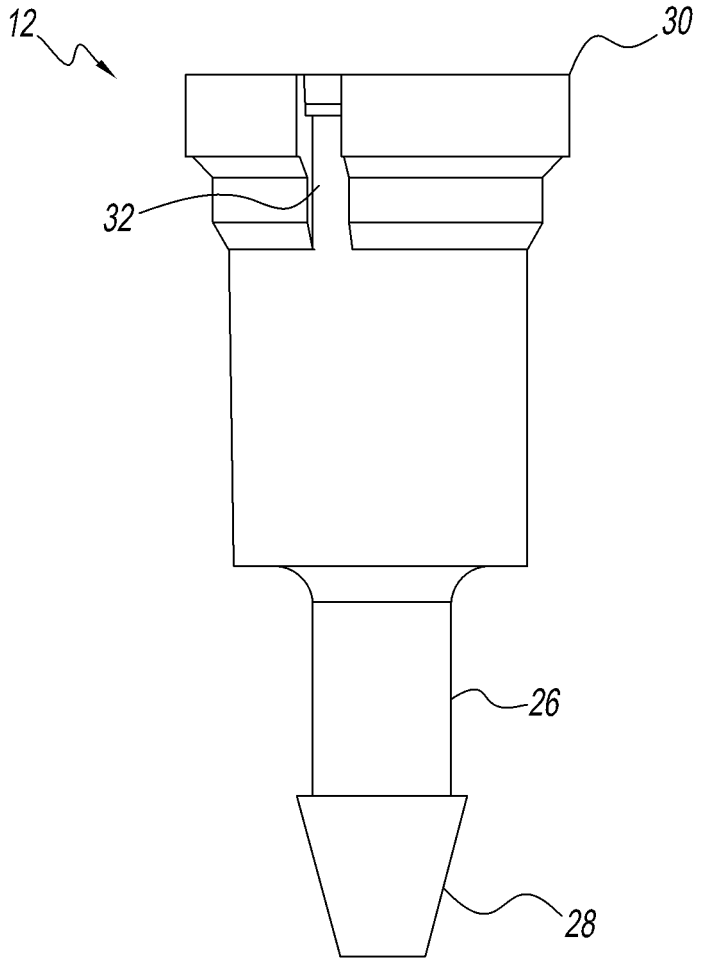
FIG. 10 is a side view of the valve housing of FIG. 9.
Figure 11:
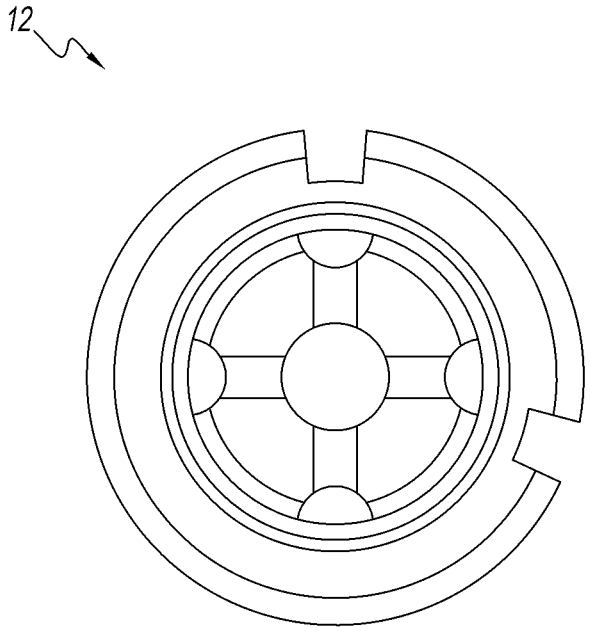
FIG. 11 is top view of the valve housing of FIG. 9 having various dimensions provided.
Figure 12:
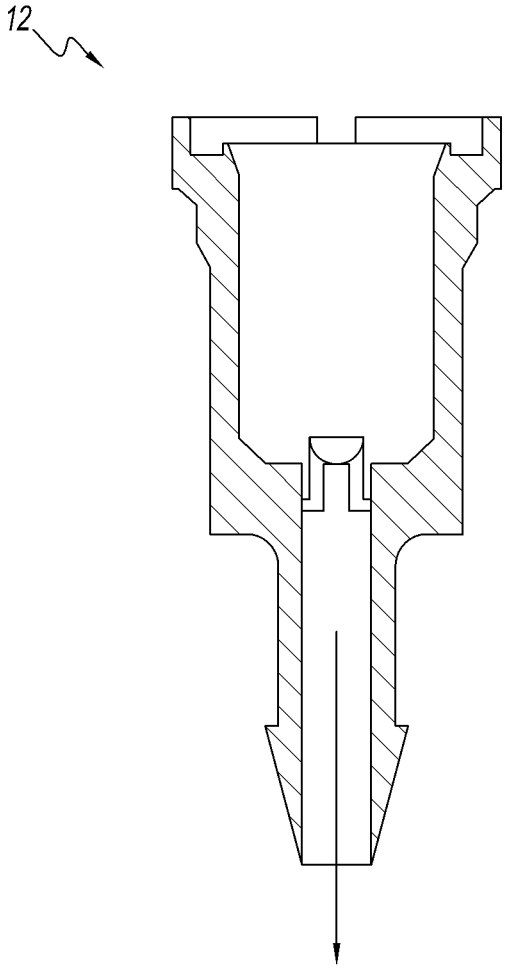
FIG. 12 is sectional view of the valve housing of FIG. 9 taken along lines 11-11 in FIG. 11 having various dimensions provided.
Figure 13:
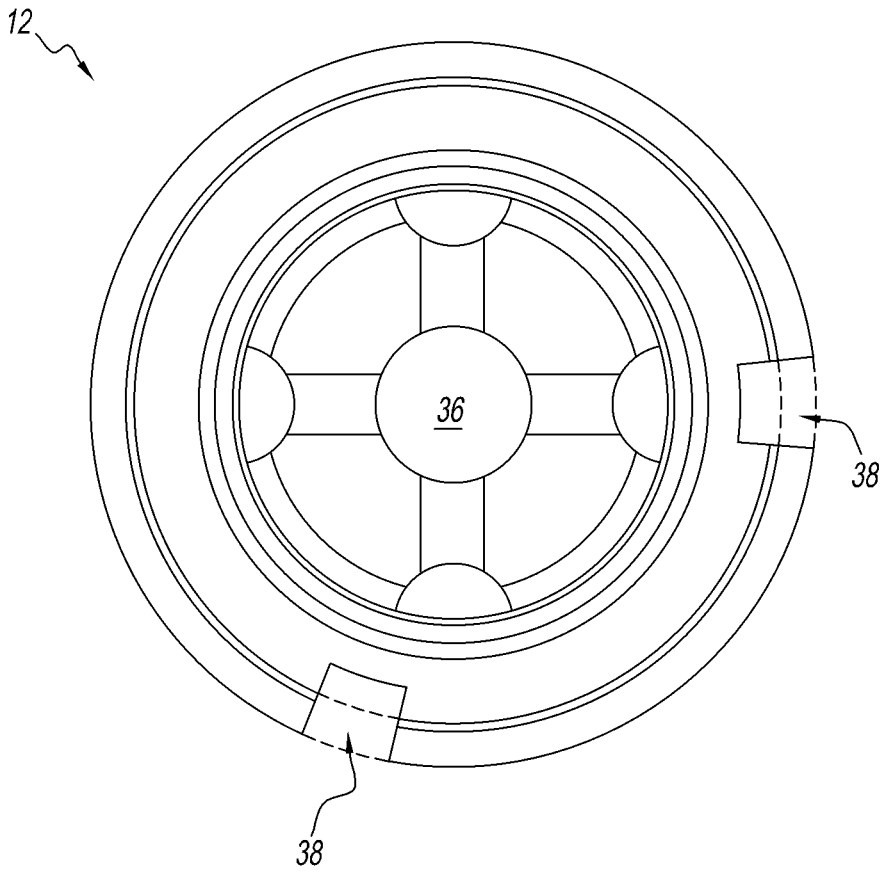
FIG. 13 is second top view of the valve housing of FIG. 9.

In this embodiment, the first minimum flow path 36 is determined by finding the minimum area of the valve stem 20, the tail piece 26, and the dip tube 14. In the embodiment illustrated in FIG. 8, the valve stem 20 has four valve stem outlet openings (only 2 shown), where the diameter of the outlet openings is 0.024 inches (in). Thus, the minimum flow path through each valve stem outlet opening is equal to $\pi*(0.024/2)^2$ or 0.00045 $in^2$, where the four outlet openings provide a first minimum flow path 36 of 0.00181 $in^2$.

Figure 6:
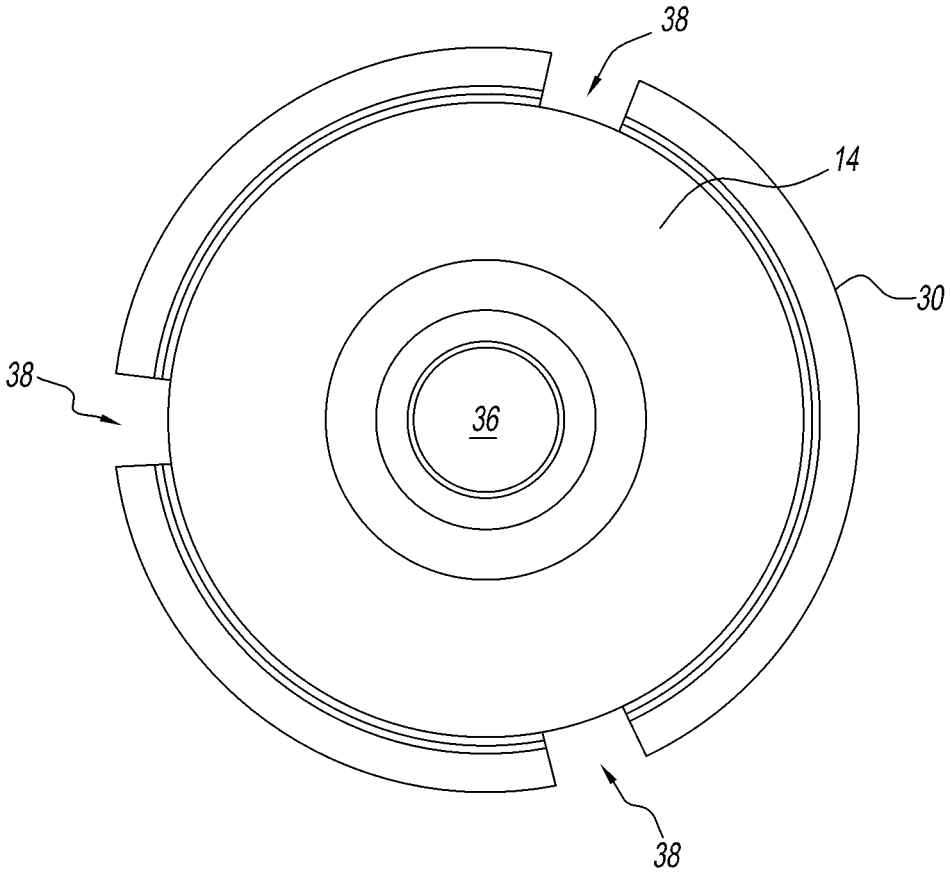
FIG. 6 is second view of the aerosol valve of FIG. 1 having the valve stem removed.
Figure 7:
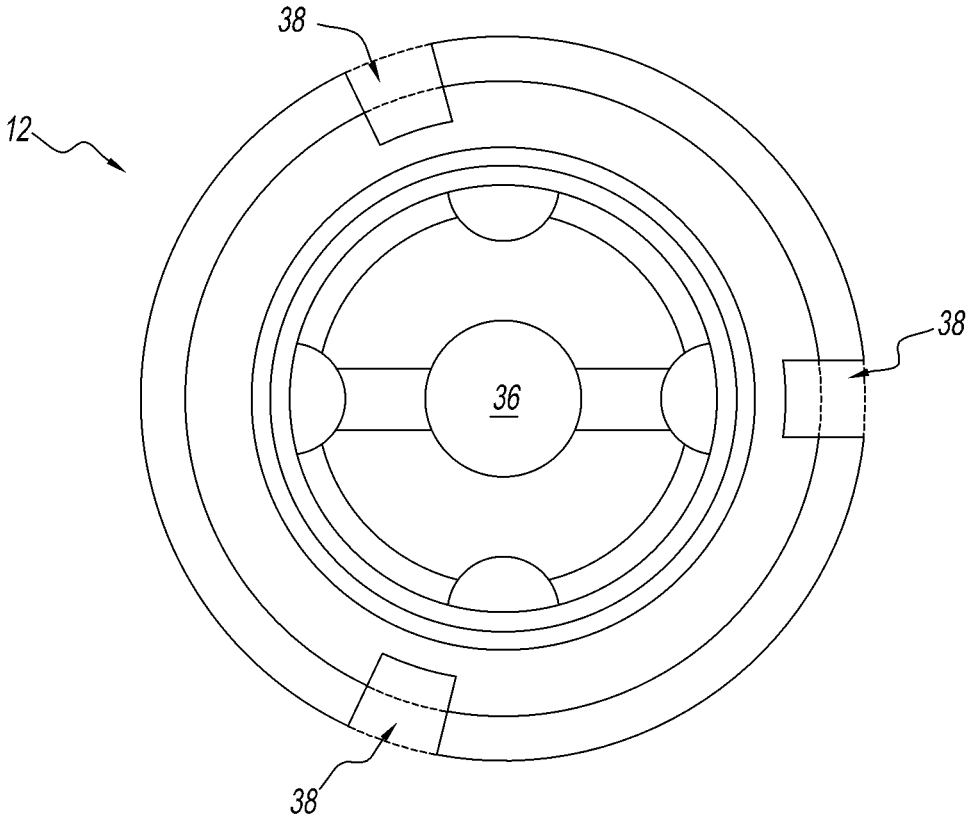
FIG. 7 is second top view of the valve housing of FIG. 2.

The second minimum flow path 38 defined by adding up the individual areas through each of the filling slots 32. The area of filling slot 32 is defined by the radial segment of the slot that is not covered by gasket 18 as shown in FIGS. 6 and 7. Thus, the minimum flow path of each filling slot 32 is equal 0.0012 $in^2$, where the three filling slots provide a second minimum flow path 38 of 0.0036 $in^2$.

Comparing the first minimum flow path 36 to the second minimum flow path 38 is of 0.00181 $in^2$ to 0.0036 $in^2$, where the flow area through the valve housing 12 is smaller than the flow area over the valve housing at crown 30. Stated another way, this embodiment of valve housing 12 provides a ratio of the first minimum flow path 36 to the second minimum flow path 38 of 1 to 1.989.

Valve housing 12 has at least one and at most five filling slots 32. When more than one filling slot 32 is present, the area of the second flow path 38 can be divided equally or un-equally between the filling slots.

The embodiment of valve housing 12 shown in FIGS. 1 through 8 is shown having three equally spaced and sized filling slots 32. Of course, it is contemplated by the present disclosure for valve housing 12 to have slots 32 unevenly spaced from one another, slots that are unequal in size to one another, and any combinations thereof.

For example, and referring to FIGS. 9 through 13, valve housing 12 is shown having two valve slots 32 that are unequally spaced from one another but are equal in size to one another.

In this embodiment, the first minimum flow path 36 is again equal to the four circular outlet openings through the valve stem 20, where the diameter of the opening is again 0.024 inches. Thus, the flow path through each valve stem outlet opening is equal to $\pi*(0.024/2)^2$ or 0.0045 $in^2$, where the four outlet openings provide a first minimum flow path 36 of 0.00181 $in^2$.

The second minimum flow path 38 is again defined by adding up the individual areas through each of the filling slots 32. Thus, the minimum flow path of each filling slot 32 is again equal 0.0012 $in^2$, where the two filling slots provide a second minimum flow path 38 of 0.0024 $in^2$.

Comparing the first minimum flow path 36 to the second minimum flow path 38 is of 0.00181 $in^2$ to 0.0024 $in^2$, where the flow area through the valve housing 12 is smaller than the flow area over the valve housing at crown 30. Stated another way, this embodiment of valve housing 12 provides a ratio of the first minimum flow path 36 to the second minimum flow path 38 of 1 to 1.326.

In this manner, aerosol valve 10 having valve housing 12 with filling slots 32 and circular gasket 18 is particularly useful for dispensers charged with soluble compressed gases. By proportioning flow inside and outside the housing, much higher pressures and flow rates can be employed.

It should be recognized that the two examples above are provided with first minimum flow area 36 being defined by the outlet openings of the valve stem 20 and the second minimum flow area being defined by the filling slots 32. However, it is contemplated by the present disclosure for the first and second minimum flow areas 36, 38 to be defined by any portion of the flow path through the valve or over the valve.

For example, it is contemplated by the present disclosure for the second minimum flow area 38 to be defined by one or more of the filling slots 32, a distance between an outer diameter of valve housing 12 and inner diameter of mounting cup 22, or other restrictions of flow over the valve housing 12.

Further, it is contemplated by the present disclosure for the first minimum flow area 36 to be defined by one or more of the valve stem inlet opening, the valve stem outlet opening, the tail piece 26, the dip tube 14 or other restrictions of flow through valve housing 12.

Accordingly, the present disclosure has determined that the complex series of variables that go into determining the balancing of flow over the valve housing as compared to through the valve housing can be surprisingly simplified by comparing the minimum flow area through each path. Using this surprisingly simplified system, it has been determined that a ratio of the first minimum flow area 36 to the second minimum flow area 38 of between 1 to 0.5 and 1 to 4, and preferably between 1 to 1 and 1 to 2.5, is effective for a large range of solubility rates for $CO_2$, as well as other soluble compressed gas propellants.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A valve housing for use in an aerosol valve, comprising:

a housing having a wall encompassing an interior volume, said wall having a top and a bottom;

a tail piece positioned at said bottom of said housing, said tail piece defining a first minimum filling area therethrough;

a crown positioned at said top of said housing, said crown having an inner surface in said interior volume and an outer surface outside of said interior volume, at least one radial slot through said inner surface and said outer surface of said crown and connecting to at least one filling slot defined through said outer surface of said crown, said at least one filling slot defining a second minimum filling area; and a ratio of said first minimum filling area to said second minimum filling area being between 1 to 0.5 and 1 to 4.

2. The valve housing of claim 1, wherein said at least one filling slot comprises a plurality of filling slots.

3. The valve housing of claim 2, wherein said second minimum filling area comprises a sum of an area of each of said plurality of filling slots.

4. The valve housing of claim 3, wherein said area of each of said plurality of filling slots are equal to one another.

5. The valve housing of claim 3, wherein said area of each of said plurality of filling slots are unequal to one another.

6. The valve housing of claim 2, wherein said plurality of filling slots comprises at most five filling slots.

7. The valve housing of claim 2, wherein said plurality of filling slots are equally spaced from one another.

8. The valve housing of claim 2, wherein said plurality of filling slots are unequally spaced from one another.

9. The valve housing of claim 1, wherein said tail piece comprises a barb disposed on an outer dimension thereof.

10. An aerosol valve comprising:

a valve housing comprising a tail piece at a bottom end and a crown at a top end, wherein said crown has an inner surface, an outer surface, and a crown-slot extending through said inner surface and said outer surface of said crown;

a valve stem in said valve housing;

a dip tube disposed on said tail piece;

a first minimum filling area through said valve housing defined through said valve stem, said tail piece, and said dip tube;

a second minimum filling area defined through said outer surface and over said valve housing, said second minimum filling area connected to said crown-slot; and a ratio of said first minimum filling area to said second minimum filling area being between 1 to 0.5 and 1 to 4.

11. The aerosol valve of claim 10, further comprising a circular gasket on said valve housing.

12. The aerosol valve of claim 10, further comprising a barb on said tail piece for frictionally engaging said dip tube.

13. The aerosol valve of claim 10, further comprising one or more filling slots defined in said crown, said second minimum filling area comprises a sum of an area of each of said one or more filling slots.

14. The aerosol valve of claim 13, wherein said one or more filling slots comprises a plurality of filling slots, said area of each of said plurality of filling slots are equal to one another or unequal from one another.

15. The aerosol valve of claim 13, wherein said one or more filling slots comprises a plurality of filling slots, said area of each of said plurality of filling slots are unequal to one another.

16. The aerosol valve of claim 13, wherein said one or more filling slots comprises at most five filling slots.

17. The aerosol valve of claim 13, wherein said one or more filling slots comprises a plurality of filling slots, said plurality of filling slots being equally spaced from one another.

18. The aerosol valve of claim 13, wherein said one or more filling slots comprises a plurality of filling slots, said plurality of filling slots being unequally spaced from one another.

19. The aerosol valve of claim 10, further comprising a mounting cup having said valve housing disposed therein.

20. The aerosol valve of claim 19, further comprising a dispensing button on said valve stem.

21. The aerosol valve of claim 10 wherein the ratio of said first minimum filling area to said second minimum filling area being between 1 to 0.5 and 1 to 1.

* * * * *